US011336019B2

(12) United States Patent
Kim et al.

(10) Patent No.: US 11,336,019 B2
(45) Date of Patent: May 17, 2022

(54) DUAL ANTENNA

(71) Applicant: LG ELECTRONICS INC., Seoul (KR)

(72) Inventors: Doojung Kim, Seoul (KR); Seungmin Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 129 days.

(21) Appl. No.: 16/815,670

(22) Filed: Mar. 11, 2020

(65) Prior Publication Data

US 2021/0111492 A1 Apr. 15, 2021

(30) Foreign Application Priority Data

Oct. 10, 2019 (KR) ..... 10-2019-0125144

(51) Int. Cl.

| | |
|---|---|
| ***H01Q 9/04*** | (2006.01) |
| ***H01Q 1/48*** | (2006.01) |
| ***H01Q 11/14*** | (2006.01) |
| ***H01Q 1/24*** | (2006.01) |

(52) U.S. Cl.

CPC ..... *H01Q 9/0457* (2013.01); *H01Q 1/243* (2013.01); *H01Q 1/48* (2013.01); *H01Q 11/14* (2013.01)

(58) Field of Classification Search

CPC ..... H01Q 9/0457; H01Q 1/48; H01Q 11/14; H01Q 1/243; H01Q 1/46; H01Q 5/371; H01Q 5/42; H01Q 9/42

See application file for complete search history.

(56) References Cited

U.S. PATENT DOCUMENTS

2011/0309985 A1* 12/2011 He ..... H01Q 9/42 343/700 MS

FOREIGN PATENT DOCUMENTS

| | | | | |
|---|---|---|---|---|
| CN | 101276955 B | * | 3/2013 | ..... H01Q 1/38 |
| CN | 106816702 A | * | 6/2017 | |
| JP | 2007281990 A | * | 10/2007 | ..... H01Q 1/362 |
| KR | 101144518 B1 | * | 5/2012 | |
| WO | WO-2017052274 A1 | * | 3/2017 | ..... H05K 1/115 |

* cited by examiner

*Primary Examiner* — Hoang V Nguyen

(74) *Attorney, Agent, or Firm* — Birch, Stewart, Kolasch & Birch, LLP

(57) ABSTRACT

Disclosed is a dual antenna including a radiation circuit. The radiation circuit includes a first pattern having an L shape, a second pattern having a meandering shape, a feed line electrically connected to the first pattern and the second patter, and a ground line spaced apart from the feed line and electrically connected to the first pattern and the second pattern.

18 Claims, 15 Drawing Sheets

DUAL ANTENNA

CROSS REFERENCE TO RELATED APPLICATION

The present application claims priority to Korean Patent Application No. 10-2019-0125144, filed in the Republic of Korea on Oct. 10, 2019, the entire contents of which is incorporated herein for all purposes by reference.

BACKGROUND OF THE INVENTION

1. Field of the Invention

The embodiments relate to a dual antenna.

2. Description of the Related Art

Electronic devices such as a smartphone have been providing more various services to users and are being equipped with more useful optional functions. Early electronic devices for a mobile communication service were equipped with only a voice call function. However, recent electronic devices for mobile communication are equipped with a wireless communication function as well as a voice call function.

Early wireless communication technology based on IEEE standard protocols (802.11 b, g, n) according to the related art is defined to use a frequency of 2.4 GHz, but recent wireless communication technology based on an improved IEEE standard protocol (802.11 a) uses a frequency of 5 GHz. In order to enable wireless communication based on multi-frequency bands, antennas capable of operating at a wider frequency band are required for electronic devices having a communication function.

On the other hand, miniaturization of electronic devices imposes a limitation on the size of an antenna that needs to be mounted inside an electronic device. Therefore, an antenna for a small electronic device tends to deal with a narrow frequency band. Thus, the development of a compact antenna capable dealing with a wide frequency band is required.

SUMMARY OF THE INVENTION

Various embodiments relate to a dual antenna capable of operating at a wide frequency band.

Various embodiments relate to a dual antenna having a reduced size that is achieved by minimizing electrical connection between adjacent antennas.

Various embodiments relate to a dual antenna capable of performing beamforming which is a technique by which an array of dual antennas operate to transmit a radio signal in a specific direction.

According to one aspect of the invention, there is provided a dual antenna including a radiation circuit including: a first pattern having an L-shape; a second pattern having a meandering shape; a feed line electrically connected to the first pattern and the second pattern; and a ground line electrically connected to the first pattern and the second pattern and spaced apart from the feed line.

The first pattern can include: a first line extending in a first direction and having a first end electrically connected to the feed line; and a second line extending, in a second direction perpendicular to the first direction, from a second end of the first line.

The second pattern can include: a first line extending parallel to the first line of the first pattern and having a first end electrically connected to the feed line; and a second line having a meandering shape and extending in the second direction from a second end of the first line of the second pattern.

The second line of the first pattern can have a width larger than that of the first line of the first pattern.

The second line of the first pattern can be provided with at least one opening.

The at least one opening can be disposed relatively far from the first line of the first pattern compared to the middle of the second line of the first pattern in terms of the second direction.

The at least one opening can include: a first opening and a second opening that are circular openings and are arranged in the first direction; and a third opening that is an elliptical opening having a larger sized than each of the first and second openings and which is spaced apart from each of the first and second openings in the second direction.

The dual antenna can further include a third pattern having an extended bar shape and having a first end connected to the feed line and a second end connected to the ground line.

The first line of the second pattern can be connected to the first end of the third pattern, and the first line of the first pattern can be spaced apart from the first line of the second pattern and can be connected to the third pattern.

The second line of the first pattern can be disposed closer to the third pattern than the second line of the second pattern.

The dual antenna can further include: an input circuit configured to receive a data signal from an external circuit; a feeder circuit electrically connected to the input circuit and configured to convert the data signal into an electrical signal and to output the electrical signal to the feed line; and a ground pad for grounding the electrical signal supplied to the ground line.

The input circuit and the feeder circuit can be connected to each other via a first line extending in the first direction from the feeder circuit and a second line extending in the second direction from the first line, and the first line and the second line can have different resistances.

The ground pad can be arranged to surround the input circuit, the feeder circuit, and the first and second lines connected between the input circuit and the feeder circuit.

The first pattern can output a radiation signal having a first frequency band and the second pattern can output a radiation signal having a second frequency band lower than the first frequency band.

According to another aspect of the invention, there is provided a dual antenna including a first radiation circuit and a second radiation circuit, each of the first and second radiation circuits including: a first pattern having an L-shape; a second pattern having a meandering shape; a feed line electrically connected to the first pattern and the second pattern; and a ground line electrically connected to the first pattern and the second pattern and spaced apart from the feed line.

The first radiation circuit and the second radiation circuit can be symmetrically arranged with respect to a first axis parallel to a first direction.

The first pattern can include a first line extending in the first direction and having a first end connected to the feed line and a second line extending, in a second direction perpendicular to the first direction, from a second end of the first line. The second pattern can include: a first line extending parallel to the first line of the first pattern and having a first end electrically connected to the feed line; and a second line extending in the second direction from a second end of the first line of the second pattern.

The dual antenna can further include: an input circuit configured to receive a data signal from an external circuit; a first feeder circuit and a second feeder circuit that are connected to the input circuit via lines, convert the data signal into electrical signals, and output the electrical signals to the feed line connected to the first pattern and the feed line connected to the second pattern, respectively; a ground pad for grounding the electrical signals supplied to the ground lines; and a first phase shifter connected between the first feeder circuit and the input circuit.

The first phase shifter can include a plurality of stages having different impedance values.

The input circuit can include a first switch that selectively connects one of the stages to the input circuit and a second switch that selectively connects one of the stages to the first feeder circuit.

The dual antenna can further include a second phase shifter connected between the second feeder circuit and the input circuit.

According to a further aspect, there is provided a dual antenna including a first layer, a second layer, a third layer, and a fourth layer that are stacked in a first direction. The first layer can include: an input circuit configured to receive a data signal from an external circuit; a feeder circuit that is electrically connected to the input circuit, converts the data signal into an electrical signal, and outputs the electrical signal; a radiation circuit that generates a radiation signal according the electrical signal output from the feeder circuit; and a first ground pad for grounding the electrical signal supplied to the radiation circuit. The second layer can include a second ground pad disposed to correspond to the first ground pad. The second layer can have openings respectively corresponding to positions of the input circuit and the feeder circuit. The third layer and the fourth layer can respectively include a third ground pad and a fourth ground pad that are arranged to correspond to the first ground pad.

The first, second, third and fourth ground pads can be electrically connected to each other through via holes.

According to various embodiments, the dual antenna enables an electronic device which is to be equipped with the dual antenna to have a reduced size and to support a wide frequency band. In addition, the dual antenna can improve performance of signal transmission by performing beamforming.

According to various embodiments, the dual antenna is provided with specifically designed openings, thereby operating at a wider frequency band.

BRIEF DESCRIPTION OF THE DRAWINGS

The above and other objects, features and other advantages of the embodiments will be more clearly understood from the following detailed description taken in conjunction with the accompanying drawings, in which.

DESCRIPTION OF THE PREFERRED EMBODIMENTS

Hereinafter, various embodiments will be described with reference to the accompanying drawings. In the description hereinbelow, details of well-known features and techniques can be omitted to avoid unnecessarily obscuring the gist of the present disclosure. It should be noted that the accompanying drawings are only for the purpose of helping understanding of exemplary embodiments but are not intended to limit the scope or spirit of the exemplary embodiments.

It is to be understood in the following description that when one element is referred to as being "provided on", "connected to", "combined with", or "coupled to" another element, it can be directly provided on, connected to, combined with, or coupled to the other element, or an intervening elements can be present therebetween.

It will be further understood that the terms "comprise", "include", "have", etc. when used in the present disclosure specify the presence of stated features, integers, steps, operations, elements, components, and/or combinations thereof but do not preclude the presence or addition of one or more other features, integers, steps, operations, elements, components, and/or combinations thereof.

It will be understood that, although the terms first, second, etc. can be used herein to describe various elements, these elements should not be limited by these terms. It will be understood that, although the terms first, second, etc. can be used herein to describe various elements, these elements should not be limited by these terms. For instance, a first element discussed below could be termed a second element without departing from the teachings of the embodiments. Similarly, the second element could also be termed the first element. As used herein, the singular forms "a", "an", and "the" are intended to include the plural forms as well, unless the context clearly indicates otherwise.

Figure 1:
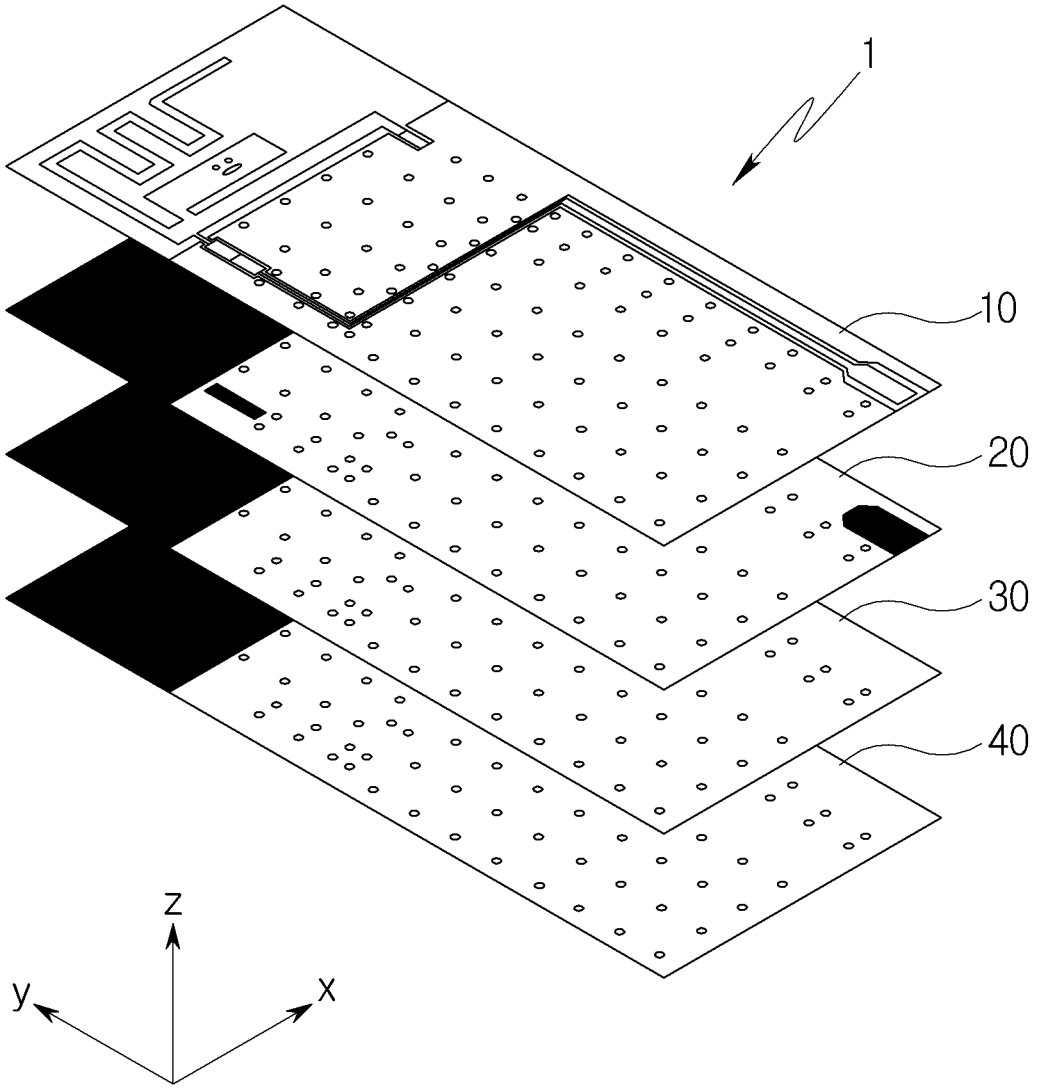
FIG. 1 is an exploded perspective view of a stacked structure of a dual antenna according to one embodiment.

FIG. 1 is an exploded perspective view of a laminated structure of a dual antenna according to one embodiment. FIGS. 2 to 5 are plan views illustrating first to fourth layers of the dual antenna of FIG. 1.

Referring to FIG. 1, a dual antenna 1 according to one embodiment includes a first layer 10, a second layer 20, a third layer 30, and a fourth layer 40 stacked in this order in a z direction. Each of the first, second, third, and fourth layers 10, 20, 30, and 40 is configured with a printed circuit board (PCB) structured such that a conductive circuit is printed on a substrate. Each of the first, second, third, and fourth layers 10, 20, 30, and 40 has a length of about 15 mm in an x-axis direction and a length of 40 mm in a y-axis direction. However, the dimensions of the first, second, third, and fourth layers 10, 20, 30, and 40 are not limited thereto.

Each of the first, second, third, and fourth layers 10, 20, 30, and 40 has a radiation area RA and a ground area GA. A radiation circuit 110 to be described later is provided within the radiation area RA of the first layer 10. The ground areas GA of the first, second, third, and fourth layers 10, 20, 30, and 40 are provided with ground pads 130, 210, 310, and 410, respectively.

Figure 2:
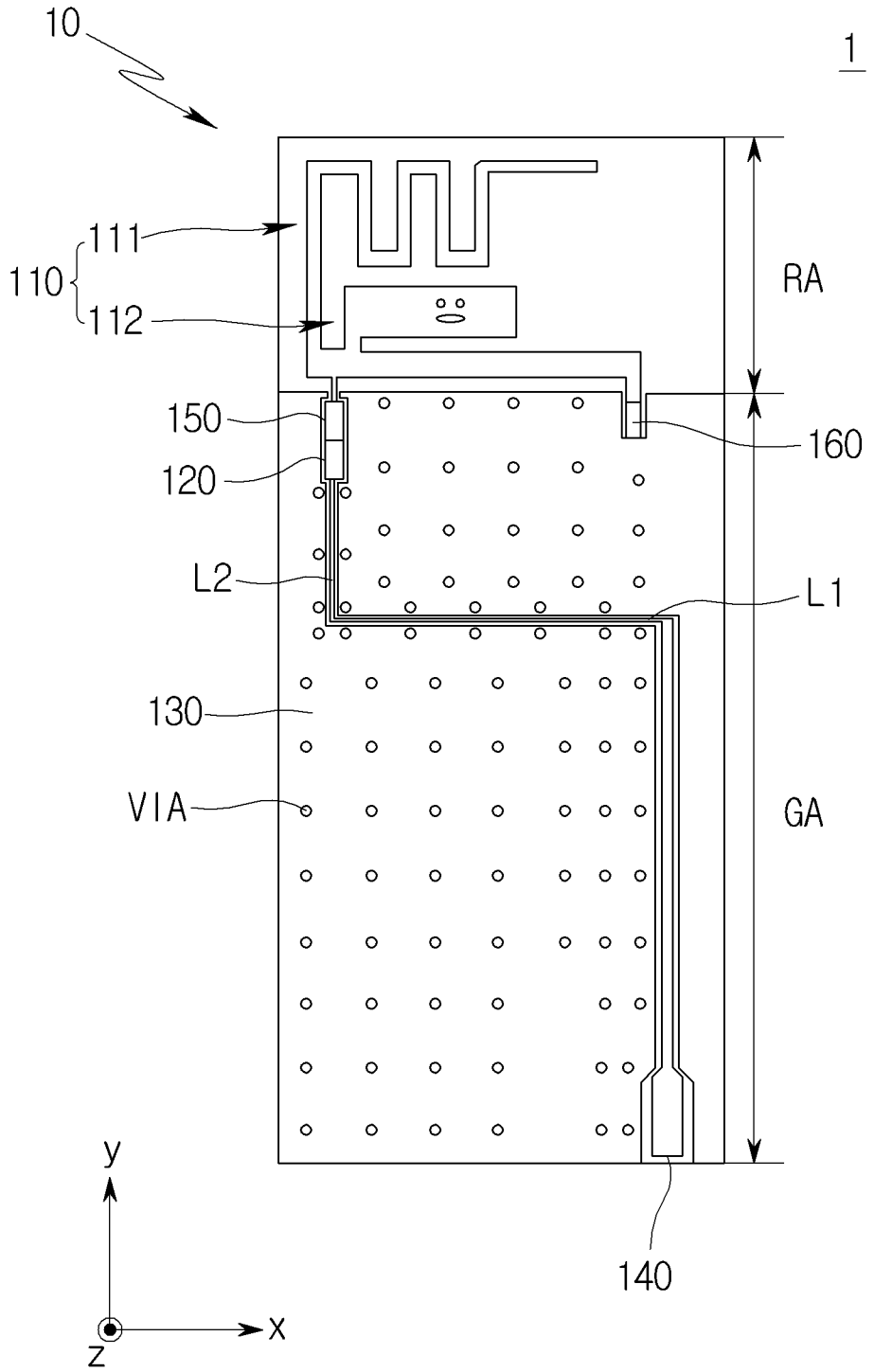
FIGS. 2 to 5 are plan views illustrating first to fourth layers of the dual antenna of FIG. 1, respectively.

Referring to FIG. 2, the first layer 10 includes a radiation circuit 110, a feeder circuit 120, a ground pad 130, and an input circuit 140 that are printed on a substrate.

The input circuit 140 transfers a data signal input from an external device to the feeder circuit 120. For example, the input circuit 140 is connected to a wireless module of an electronic device in which the dual antenna 1 is to be mounted, thereby transmitting and receiving the data signal to and from the wireless module. The input circuit 140 is electrically connected to the feeder circuit 120 through lines L1 and L2. Here, each of the lines L1 and L2 can be a microstrip line and has different resistances. According to one embodiment, the first line L1 extends in the x-axis direction and has a resistance of about 33Ω. The second line L2 extends in the y-axis direction and has a resistance of about 50Ω. The data signal input to the input circuit 140 undergoes primary impedance matching while passing through the first line L1, then undergoes secondary impedance matching while passing through the second line L2, and then travels to the feeder circuit 120.

The ground pad 130 functions to ground an electrical signal flowing to the radiation circuit 110. The ground pad 130 is formed to surround the input circuit 140, the feeder circuit 120, and the lines L1 and L2. For example, the ground pad 130 is formed in an area in which the radiation circuit 110 is not formed, except for some regions of the area in which the input circuit 140, the feeder circuit 120, and the lines L1 and L2 are formed.

The feeder circuit 120 is spaced a predetermined distance from the ground pad 130. The feeder circuit 120 is electrically connected to the input circuit 140 via the lines L1 and L2, converts the data signal received from the input circuit 140 into an electrical signal, and transmits the electrical signal to the radiation circuit 110. In various embodiments, the feeder circuit 120 is defined as an element including electrical conduction paths (for example, the lines L1 and L2) for transferring the electrical signal which is input via the input circuit 140 to the radiation circuit 110.

The feeder circuit 120 and the ground pad 130 can be electrically connected to the radiation circuit 110 via matching elements 150 and 160, respectively. Examples of the matching elements 150 and 160 include passive elements such as resistors, inductors, and capacitors and active elements such as switches. The matching elements 150 and 160 perform electrical matching between the feeder circuit 120 and the radiation circuit 110 and between the ground pad 130 and the radiation circuit 110. In various embodiments, the matching elements 150 and 160 have a width of about 0.6 mm in the x-axis direction and a width of about 2.6 mm in the y-axis direction, but the widths of the matching elements 150 and 160 are not limited thereto.

The radiation circuit 110 is configured to produce resonance at one or more frequency bands according to the electric signal input from the feeder circuit 120. A radiation signal generated by the resonance of the radiation circuit 110 can be radiated into the air.

To this end, the radiation circuit 110 includes a first pattern 111 operating at a first frequency band and a second pattern 112 operating at a second frequency band. A specific form of each of the first pattern 111 and the second pattern 112 will be described in detail below with reference to FIG. 6.

The radiation circuit 110 is electrically connected to the feeder circuit 120 and to the ground pad 130 via the matching element 150 and the matching element 160, respectively. The electrical signal output from the matching element 150 connected with the feeder circuit 120 is applied to the radiation circuit 110. The radiation signal received through the radiation circuit 110 is transmitted to the ground pad 130 via the matching element 160.

The radiation circuit 110, the feeder circuit 120, the ground pad 130, and the input circuit 140 are made of a conductive material. Examples of the conductive materials include, but are not limited to, pure metals such as copper (Cu), silver (Ag), gold (Au), and aluminum (Al) and alloys of these. The radiation circuit 110, the feeder circuit 120, the ground pad 130, and the input circuit 140 can be formed by a single etching process or a direct printing process, but a method of forming the radiation circuit 110, the feeder circuit 120, the ground pad 130, and the input circuit 140 may not be limited thereto.

Figure 3:
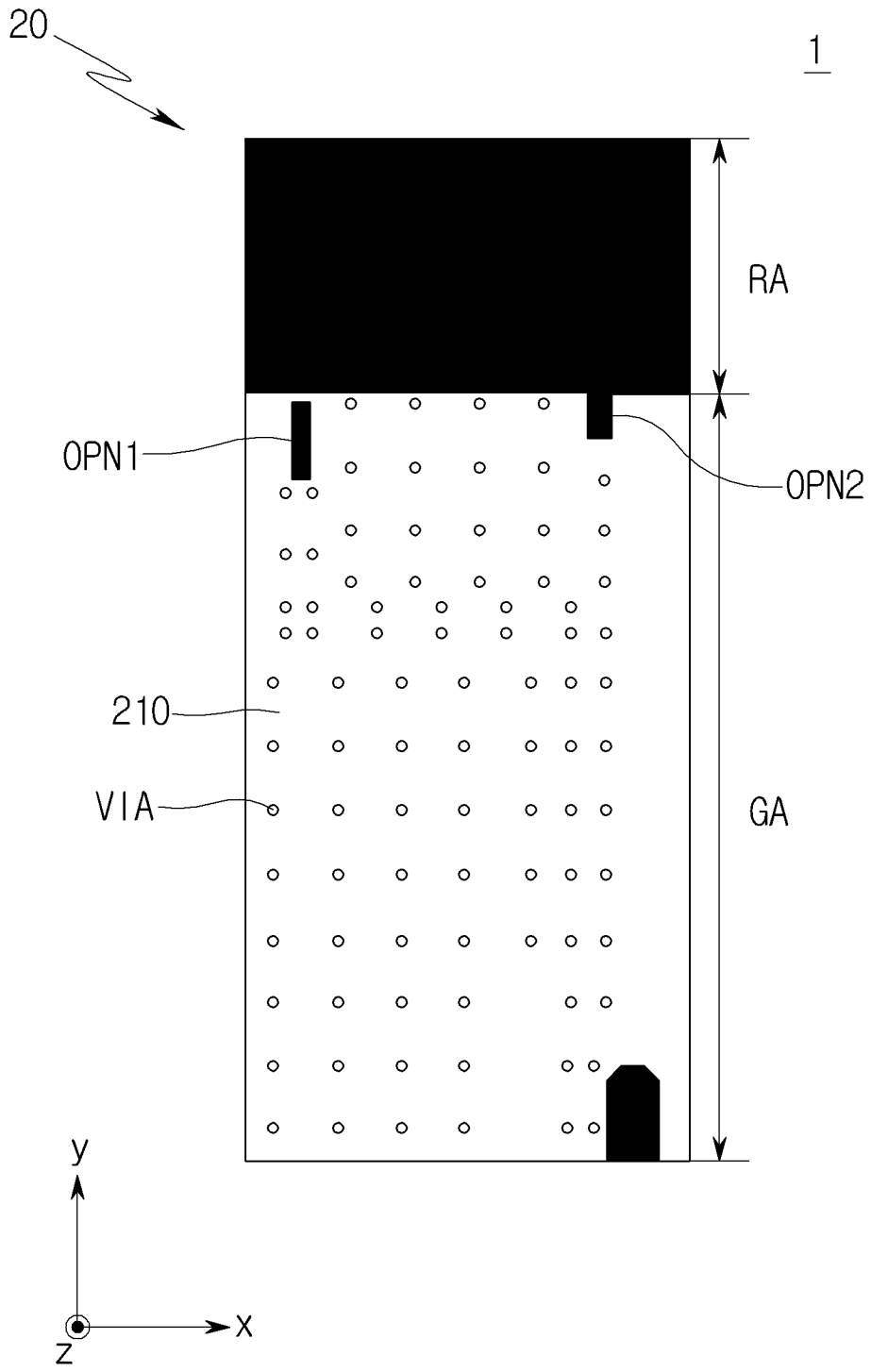
Figure 4:
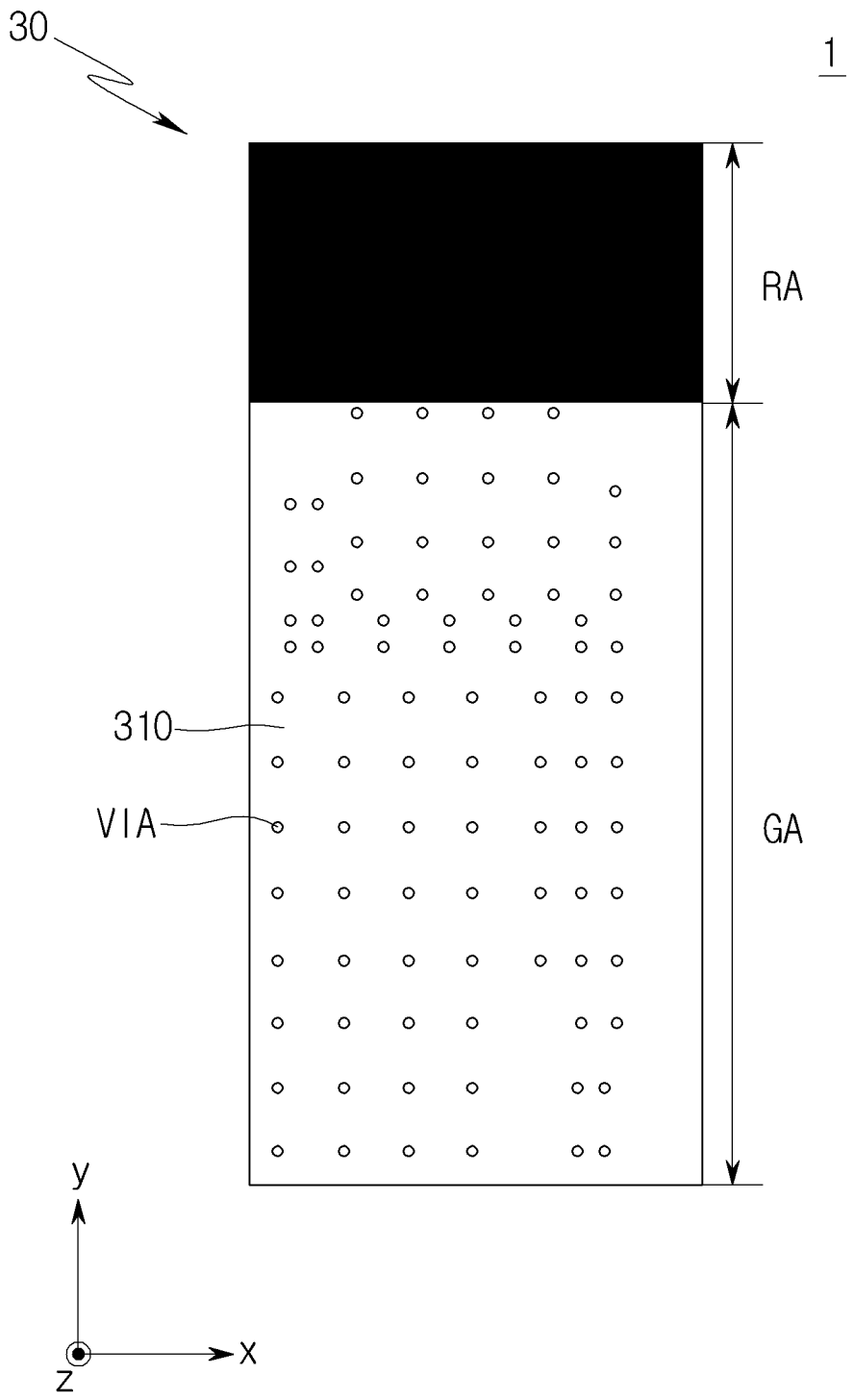
Figure 5:
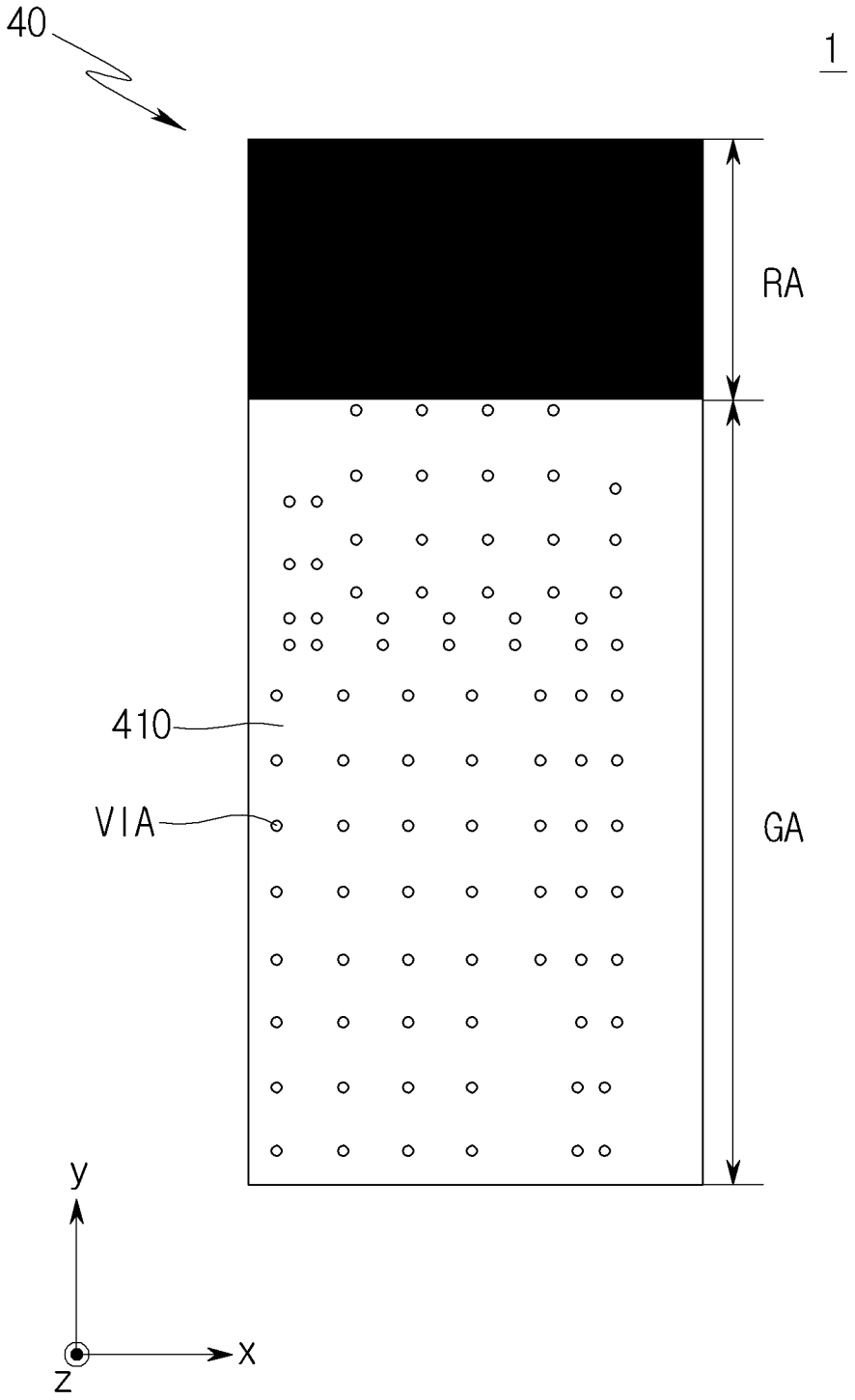

Referring to FIGS. 3 to 5, the second layer 20, the third layer 30, and the fourth layer 40 include the ground pad 210, the ground pad 310, and the ground pad 410, respectively. The ground pads 210, 310, 410 of the second layer 20, the third layer 30, and the fourth layer 40 are disposed to correspond to the ground pad 130 of the first layer 10.

The ground pads 130, 210, 310, and 410 of the first, second, third, and fourth layers 10, 20, 30, and 40 are electrically connected to each other via holes VIA.

The ground pad 210 of the second layer 20 is provided with openings OPN1 and OPN2 at positions respectively corresponding to the matching elements 150 and 160. Due to the presence of the openings OPN1 and OPN2, an electromagnetic impact of the ground pad 210 of the second layer 20 on the matching elements 150 and 160 is reduced, and thus the accuracy of impedance matching is improved.

Figure 6:
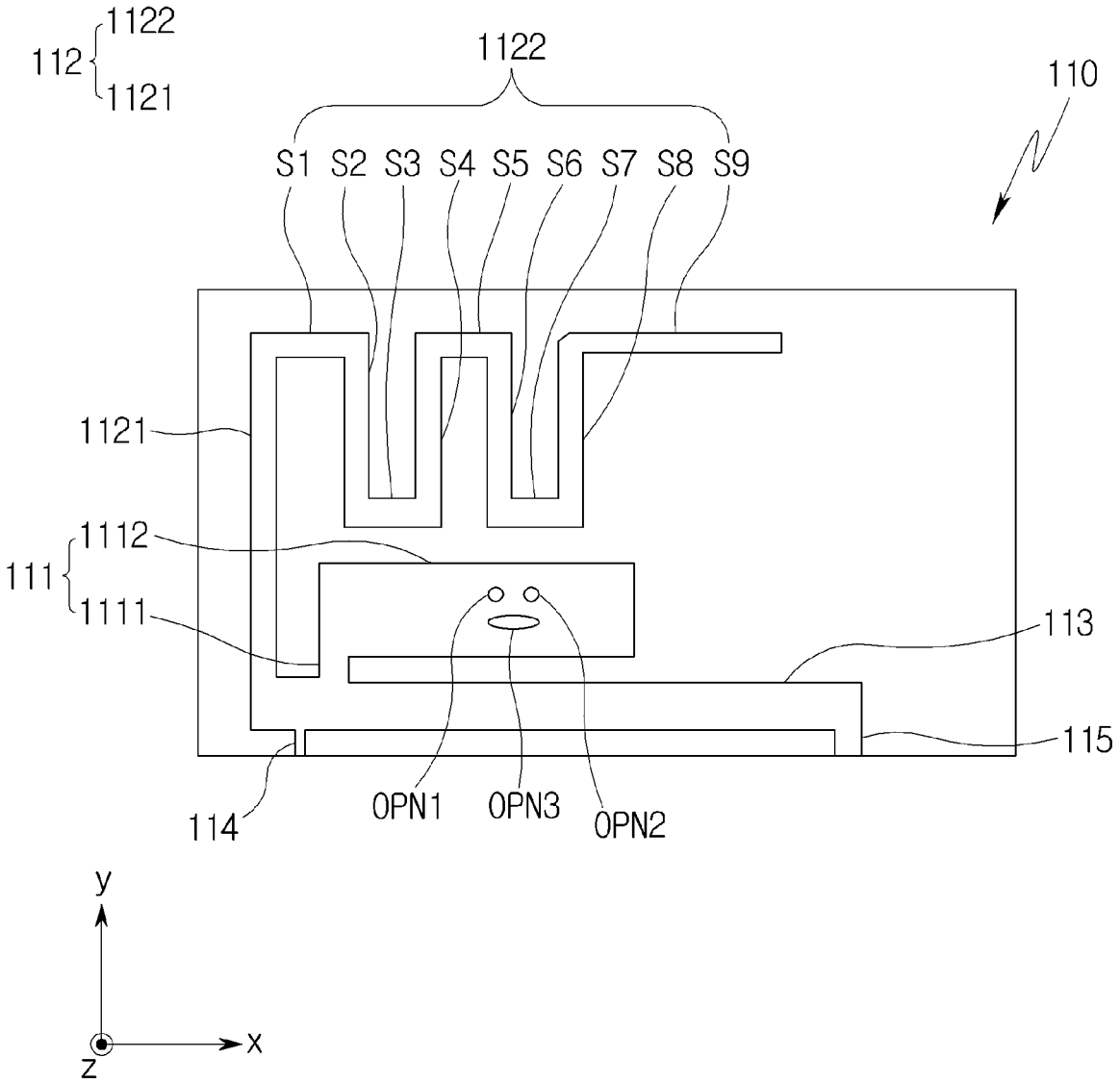
FIG. 6 is an enlarged plan view of a radiation circuit of FIG. 1.
Figure 7:
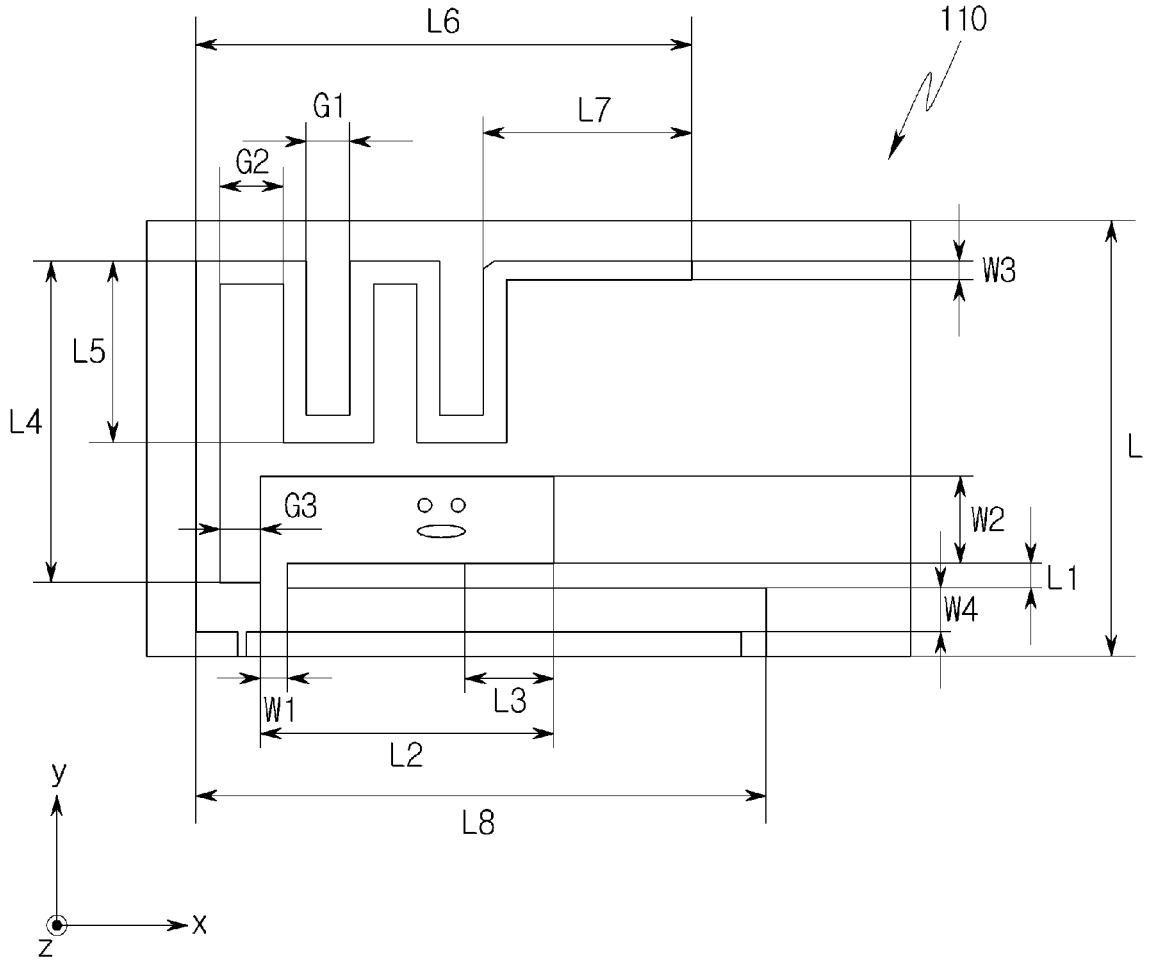
FIG. 7 is a view used to describe dimensions of patterns of the radiation circuit of FIG. 6.

FIG. 6 is an enlarged plan view of the radiation circuit illustrated in FIG. 1. FIG. 7 is a view used to describe the dimensions of patterns of the radiation circuit of FIG. 6.

Referring to FIGS. 6 and 7, the radiation circuit 110 includes a first pattern 111 resonating with a first frequency band and the second pattern 112 resonating with a second frequency band. According to one embodiment, the first frequency band can be higher than the second frequency band. For example, the first frequency band can range from 5 GHz to 5.5 GHz, and the second frequency band can be around 2.4 GHz.

The first pattern 111 and second pattern 112 are electrically connected to the feed line 114 and the ground line 115 via the matching elements 150 and 160 illustrated in FIG. 2. Since the matching elements 150 and 160 are spaced apart a uniform distance from each other along the x-axis direction, the feed line 114 and the ground line 115 are also spaced apart the same interval from each other.

The first pattern 111 may generally have a L-shape. Specifically, the first pattern 111 includes a first line 1111 extending in the y-axis direction and having a first end electrically connected to the feed line 114 and the ground line 115, and a second line 1112 extending in the x-axis direction from a second end of the first line 1111. The second line 1112 receives an electric current to be applied to the feed line 1114 through the first line 1111.

According to one embodiment, the width W2 of the second line 1112 in the y-axis direction can be larger than the width W1 of the first line 1111 in the x-axis direction. According to one embodiment, the width W1 of the first line 1111 is about 0.5 mm and the width W2 of the second line 1112 is about 2 mm. The length L1 of the first line 1111 is about 0.5 mm and the length L2 of the second line 1112 is about 6.7 mm. However, the dimensions of the first line 1111 and the second line 1112 are not limited to the values described above.

In various embodiments, the second line 1112 of the first pattern 111 is provided with one or more openings having a specific form. For example, the openings can have the same size or different sizes. Each of the openings can have the form of a circle, an ellipse, or a polygon. In the illustrated embodiment, the openings include first and second circular openings OP1 and OP2 arranged in the x-axis direction and a third elliptical opening OPN3 which is spaced a predetermined distance from each of the first and second openings OP1 and OP2 in the x-axis direction. The third opening OPN3 can have a larger size than each of the first and second openings OPN1 and OPN2. The longer axis of the third opening OPN3 is substantially parallel to the x axis and the shorter axis of the third opening OPN3 is substantially parallel to the y axis. However, the shape of the openings is not limited thereto. According to one embodiment, the openings can be spaced apart at least 0.6 mm from the edge of the second line 1112.

Figure 8:
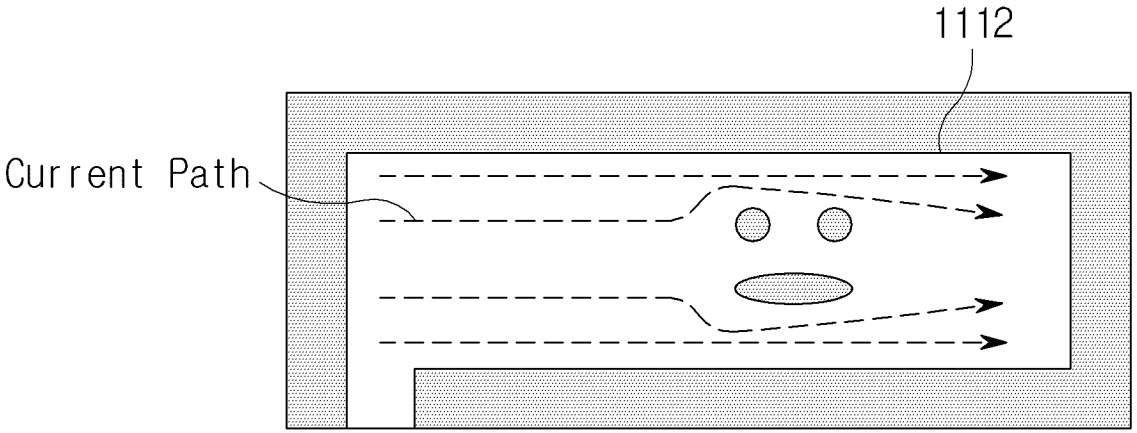
FIG. 8 illustrates current paths within a second line illustrated in FIG. 6.

A current path extending along the second line 1112 is controlled by the openings formed in the second line 1112. FIG. 8 illustrates directions along which the current flows through the second line 1112. The flow of current is blocked at the regions in which the openings are formed. Therefore, the path for the current flowing through the second line 1112 is folded in the vicinity of each of the openings as illustrated in FIG. 8. When various forms of current paths are formed in one line, since the bandwidth of the radiation signal radiated from the line increases, the radiation signal which is radiated from the second line 1112 due to the openings can have a wider frequency band.

In various embodiments, the openings can be disposed relatively far from the first line 1111 compared to the middle of the second line in terms of the longitudinal direction (that is, the x-axis direction) of the second line 1112. For example, when the second line 1112 has a length L2 of 6.7 mm, a distance L3 from the opening to an open end of the second line 1112 can be 2 mm. In this case, the current flowing into the second line 1112 from the first line 1111 can be reliably fed to the second line 1112 without being hindered by the openings.

The second pattern 112 includes a first line 1121 extending in the y-axis direction and having a first end electrically connected to the feed line 114 and the ground line 115, and a second line 1122 extending in the x-axis direction from a second end of the first line 1121.

The second line 1122 has a meandering shape (e.g. repeated pattern shape or sinusoidal shape). The meandering shape is formed by folding the line to have a crank shape. The characteristics of an antenna are determined depending on the length, the width, the number of folds, and the interval between the folds of the line.

According to one embodiment, the first line 1121 can have a length L4 of 8.5 mm, but the length L4 is not limited thereto. In the illustrated embodiment, the second line 1122 is folded 8 times. That is, the second line 1122 is composed of a first group of segments S2, S4, S6, and S8 arranged to be parallel to the first line 1121 and a second group of segments S1, S3, S5, S7, and S9 arranged to be perpendicular to the first line 1121 and connected to the first group of segments S2, S4, S6, and S8. According to one embodiment, each of the first group of segments S2, S4, S6, and S8 has a length L5 of 4.2 mm, and a first gap G1 between each of the segments S2, S4, S6, and S8 is about 1 mm. A second gap G2 between the first line 1121 and a first first-group segment S2 can be wider than the first gap G1 which is a gap between each of the first-group segments S2, S4, S6, and S8. The second gap G2 is about 1.5 mm. The length L6 of the second line is defined as the sum of the lengths of the second-group segments S1, S3, S5, S7, and S9, and it can be, for example, 11.3 mm. Among them, the length L7 of a fifth second-group segment S9 that provides the open end of the second line 1122 can be longer than the length of the other second-group segments S1, S3, S5, and S7, and it can be, for example, 4.3 mm.

The width W3 of the second line 1122 can be the same or different from the width of the first line 1121. For example, the width W3 of the first line 1121 and the second line 1122 can be 0.5 mm.

In various embodiments, the first pattern 111 and the second pattern 112 can be connected to the feed line 114 and the ground line 115 via a third pattern 113. One end (first end) of the third pattern 113 is connected to the feed line 114 and the other end (second end) of the third pattern 113 is connected to the ground line 115. The feed line 114 and the ground line 115 are spaced apart a predetermined interval from each other, and the third pattern 113 has an extended bar shape and extends the feed line 114 to the ground line 115. In this case, the length L8 of the third pattern 113 is determined depending on the distance between the feed line 114 and the ground line 115. For example, the length L8 of the third pattern 113 is 13 mm, and the width W4 of the third line 113 is 1 mm.

The first line 1121 of the second pattern 112 is connected to the first end of the third pattern 113. The first line 1111 of the first pattern 111 is spaced at a predetermined distance from the first line 1121 of the second pattern 112 and is connected to third pattern 113. According to one embodiment, a third gap G3 between the first line 1111 of the first pattern 111 and the first line 1121 of the second pattern 112 is 1 mm.

The third pattern 113 is disposed closer to the ground pattern 130 than to the first pattern 111 and the second pattern 112. Then, since the length L1 of the first line 1111 of the first pattern 111 is smaller than the length L4 of the first line 1121 of the second pattern 112, the second line 1112 of the first pattern 111 is disposed closer to the third pattern 113 than to the second line 1122 of the second pattern 112.

The radiation circuit 110 is configured with the first pattern 111 and the second pattern 112 having a meandering shape, thereby implementing a dual mode antenna which supports multiple frequency bands. In addition, since the first and second patterns 111 and 112 are configured in the way described above, the first and second patterns 111 and 112 can occupy only a small area. In the embodiment illustrated in FIGS. 6 and 7, the length L of the radiation area RA in the y-axis direction is minimized to about 0.16 times the wavelength λ, of the radiation signal in the first frequency band.

That is, since the first pattern 111 has an L shape instead of an extended bar shape, the length of a portion of the first line 1111 disposed close to the second pattern 112 is minimized. Therefore, the interference between the first pattern 111 and the second pattern 112 is reduced.

Figure 9:
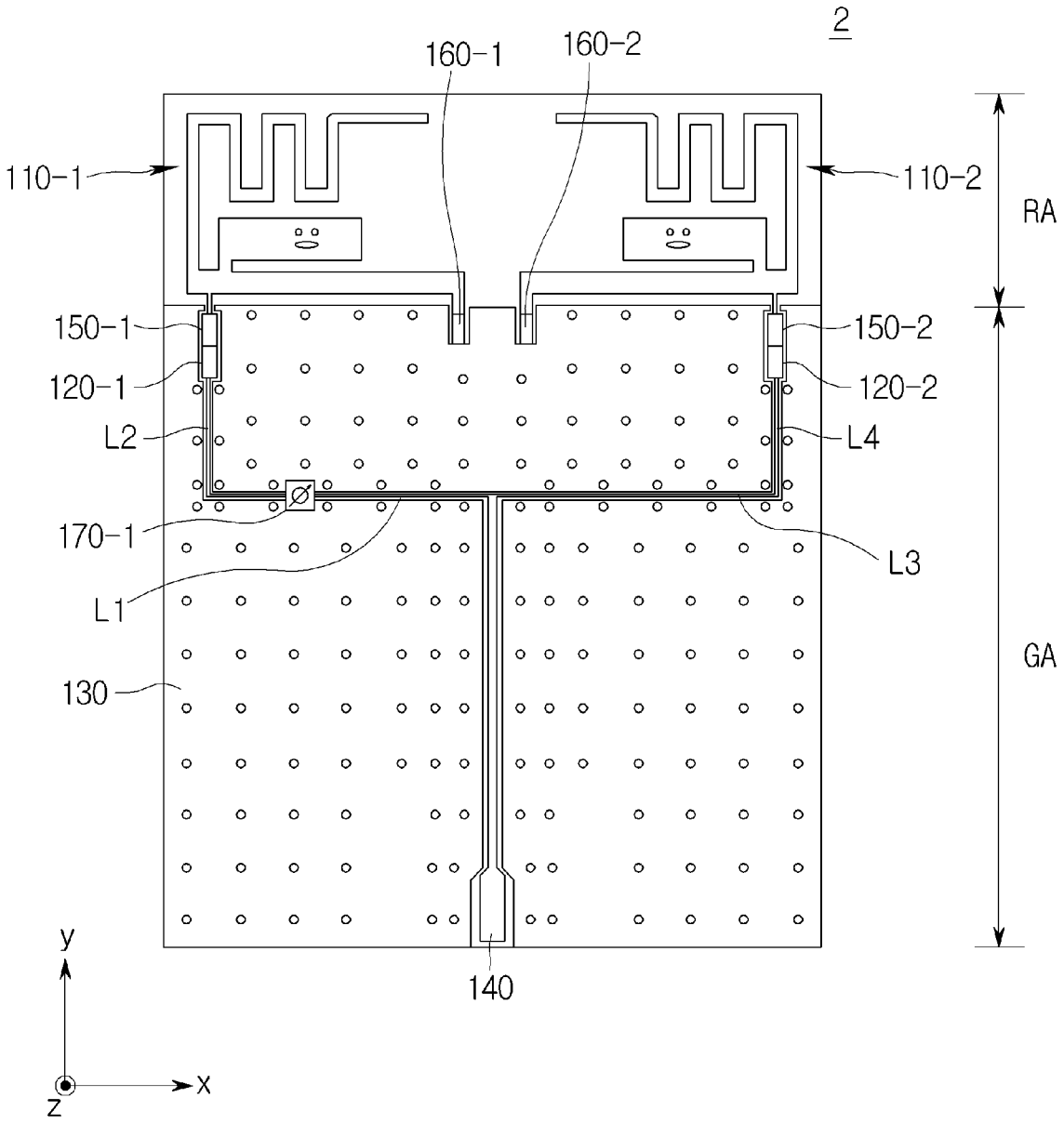
FIG. 9 is a plan view of a dual antenna according to another embodiment.
Figure 10:
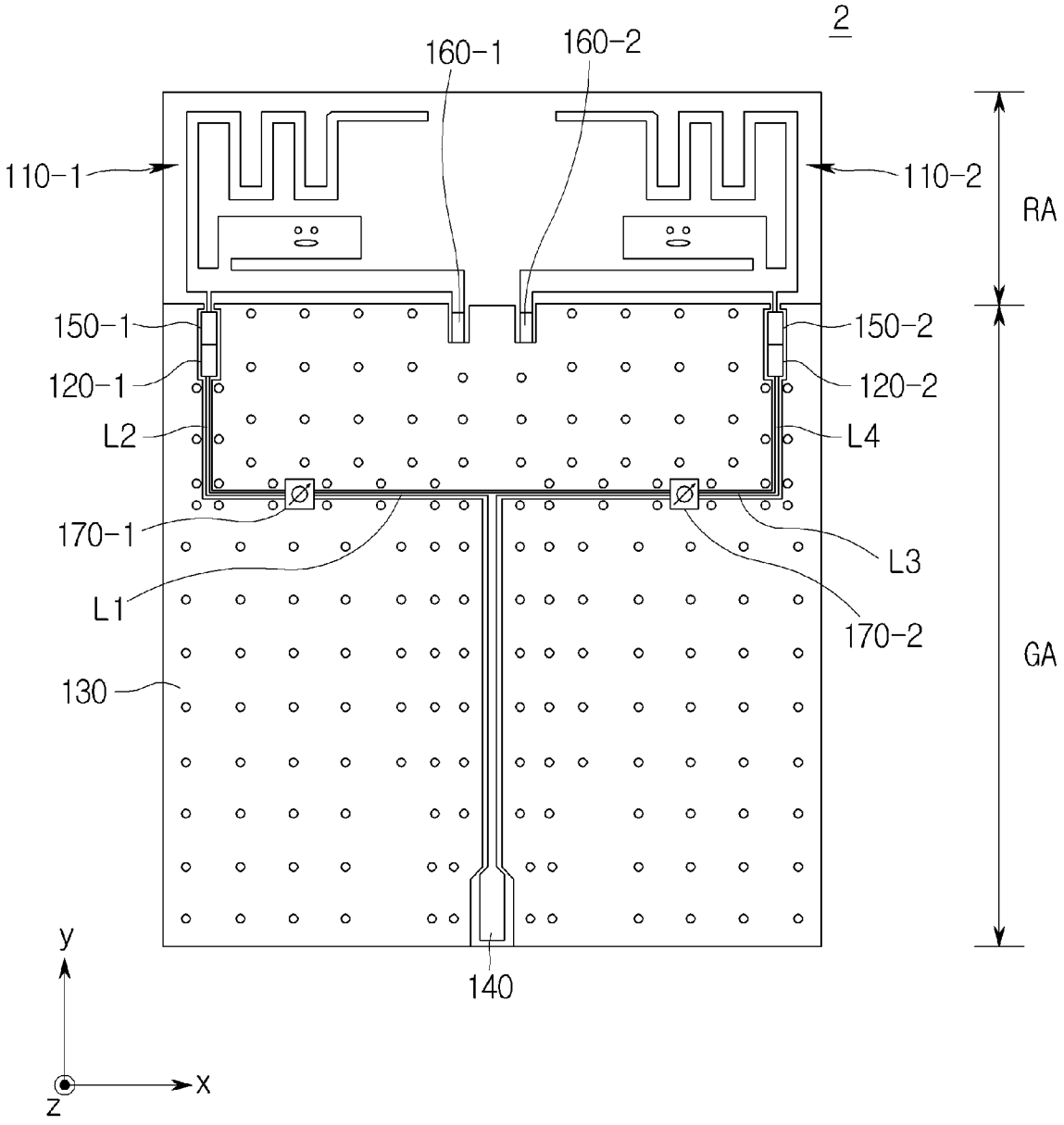
FIG. 10 is a plan view of a dual antenna according to a further embodiment.

FIG. 9 is a plan view of a dual antenna according to another embodiment. FIG. 10 is a plan view of a dual antenna according to a further embodiment.

Referring to FIG. 9, a dual antenna 2 includes a first radiation circuit 110-1 and a second radiation circuit 110-2 disposed within a radiation area RA. The first radiation circuit 110-1 is substantially the same as the radiation circuit 110 that has been described above with reference to FIGS. 1 to 8. Therefore, a detailed description of the first radiation circuit 110-1 will be omitted. The second radiation circuit 110-2 and the first radiation circuit 110-1 are axially symmetric (i.e., a mirrored structure) with respect to a y axis.

The first radiation circuit 110-1 is electrically connected to a first feeder circuit 120-1 through a matching element 150-1. The first feeder circuit 120-1 is connected to an input circuit 140 via the lines L1 and L2. The first radiation circuit 110-1 is electrically connected to a ground pad 130 via a matching element 160-1.

Similarly, the second radiation circuit 110-2 is electrically connected to a second feeder circuit 120-2 through a matching element 150-2. The second feeder circuit 120-2 is connected to the input circuit 140 via lines L3 and L4. The second radiation circuit 110-2 is electrically connected to the ground pad 130 via a matching element 160-2.

In the embodiment shown in FIG. 9, the dual antenna 2 has asymmetrical structure with respect to the y axis. That is, the dual antenna 2 has a mirror structure. The first feeder circuit 120-1 and the second feeder circuit 120-2 are disposed relatively far from the axis of symmetry. Accordingly, the interference between an electric current flowing through the first radiation circuit 110-1 and an electric current flowing through the second radiation circuit 110-2 is minimized.

The dual antenna 2 illustrated in FIG. 9 uses the plurality of radiation circuits 110-1 and 110-2 and function as a multi-input multi-output (MIMO) antenna that can communicate with a plurality of spatially separated counterparts using the same frequency at the same time. The dual antenna 2 can perform beamforming to radiate electromagnetic waves to a specific counterpart using the plurality of radiating circuits 110-1 and 110-2.

When a first radiation signal is emitted from the first radiation circuit 110-1 and a second radiation signal is emitted from the second radiation circuit 110-2 adjacent to the first radiation circuit 110-1, one of the radiation signals emitted in a specific direction is amplified and the other one of the radiation signals emitted in a different direction is attenuated due to the interference between the radiation signals. In this case, it is possible to determine the direction toward which an amplified radiation signal is to be transmitted by adjusting the phase of either the first radiation signal or the second radiation signal. That is, it is possible to perform beamforming toward a specific counterpart terminal by controlling signal radiation patterns with the first radiation circuit 110-1 and the second radiation circuit 110-2.

For phase control of the radiation signal, the dual antenna 2 additionally includes a phase shifter 170-1. The phase shifter 170-1 is disposed between the first feeder circuit 120-1 and the input circuit 140. For example, the phase shifter 170-1 can be disposed on the first line L1.

The phase shifter 170-1 controls the phase of an electrical signal which is to be transmitted to the first radiation circuit 110-1 through the first feeder circuit 120-1. In the embodiment illustrated in FIG. 9, the dual antenna 2 controls only the phase of an electrical signal to be transmitted to the first radiation circuit 110-1. However, the technical spirit of the present embodiment is not limited thereto. Alternatively, the dual antenna 2 can control the phases of all the electrical signals to be transmitted to the first radiation circuit 110-1 and the second radiation circuit 110-2. In this case, as illustrated in FIG. 10, the dual antenna 2 additionally includes a phase shifter 170-2 that controls the phase of an electrical signal to be transmitted to the second radiation circuit 110-2 through the second feeder circuit 120-2. The phase shifter 170-2 is disposed between the second feeder circuit 120-2 and the input circuit 140. Specifically, the phase shifter 170-2 can be disposed on the third line L3.

Figure 11:
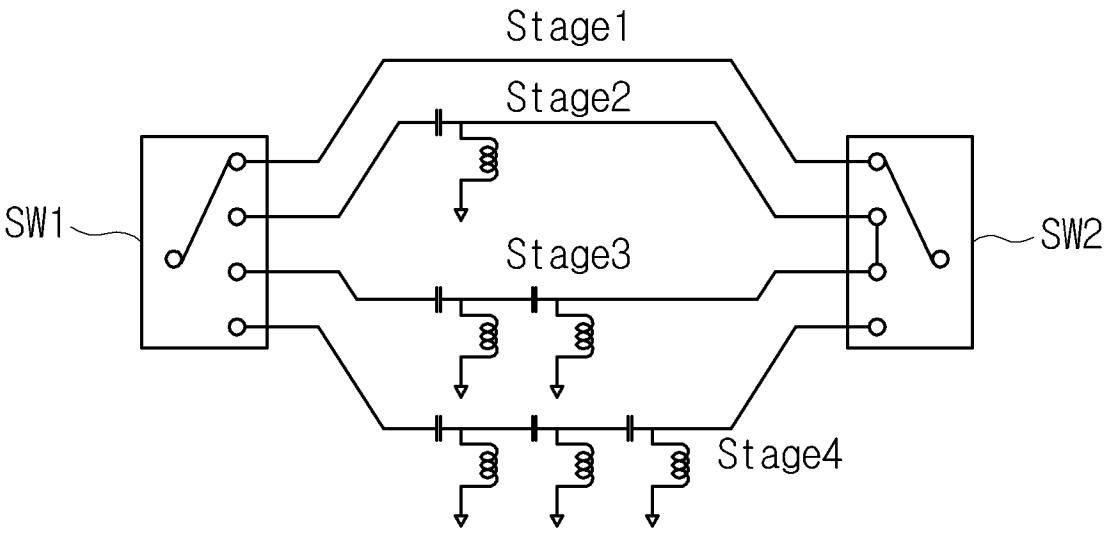
FIG. 11 is a circuitry diagram of a phase shifter according to one embodiment illustrated in FIGS. 9 and 10.
Figure 12:
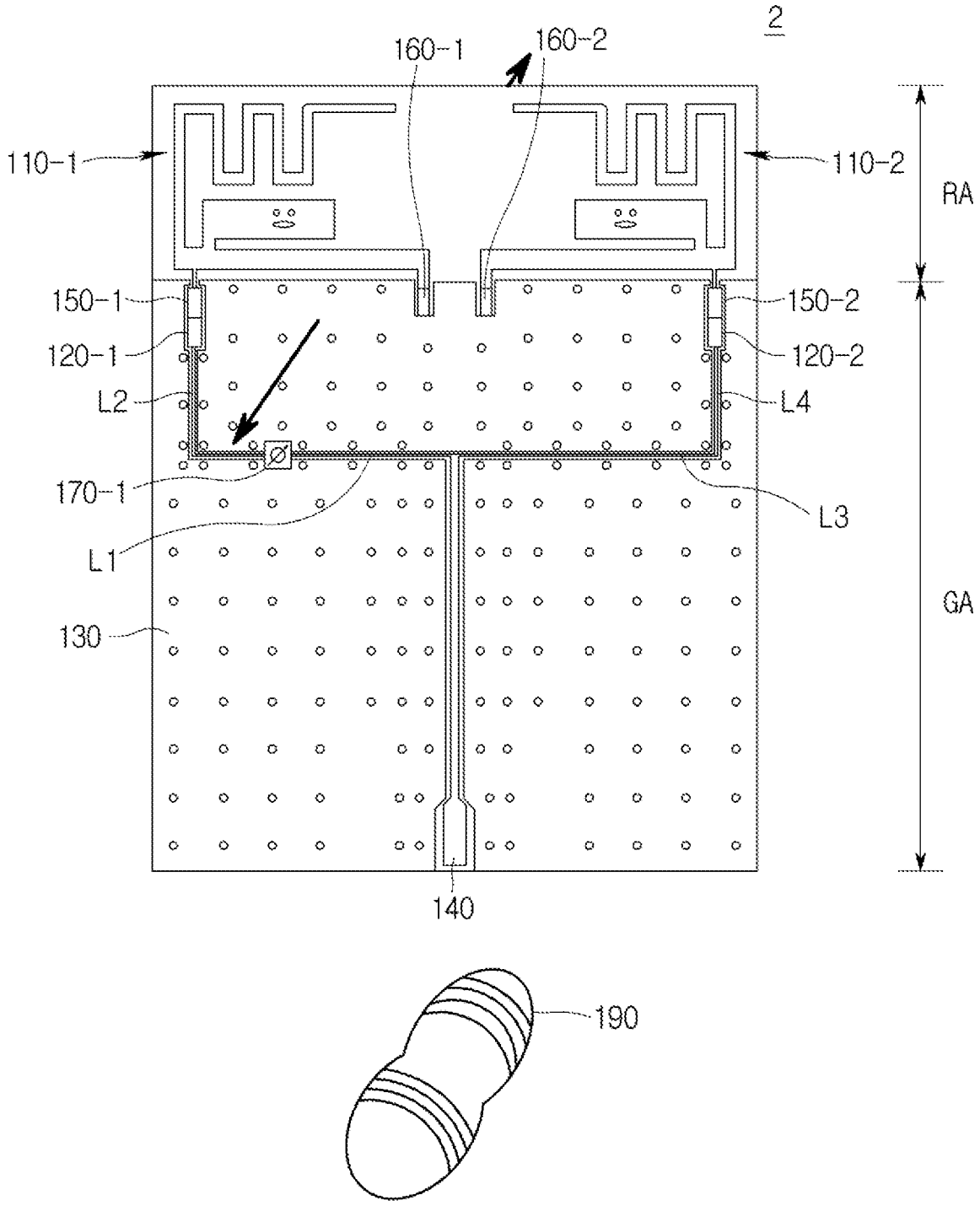
FIGS. 12 to 15 illustrate various radiation patterns corresponding to respective stages of a phase shifter of a dual antenna.
Figure 13:
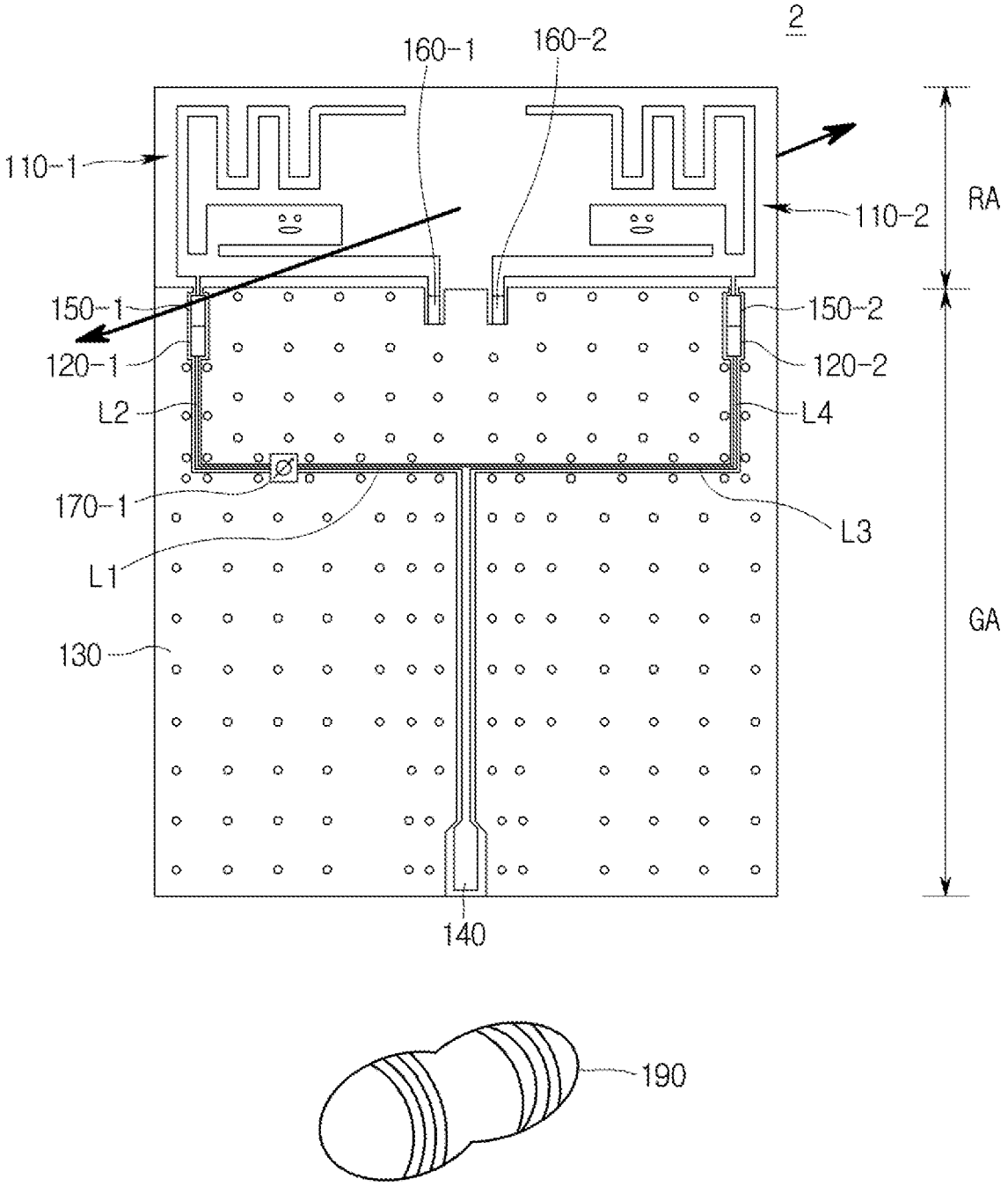
Figure 14:
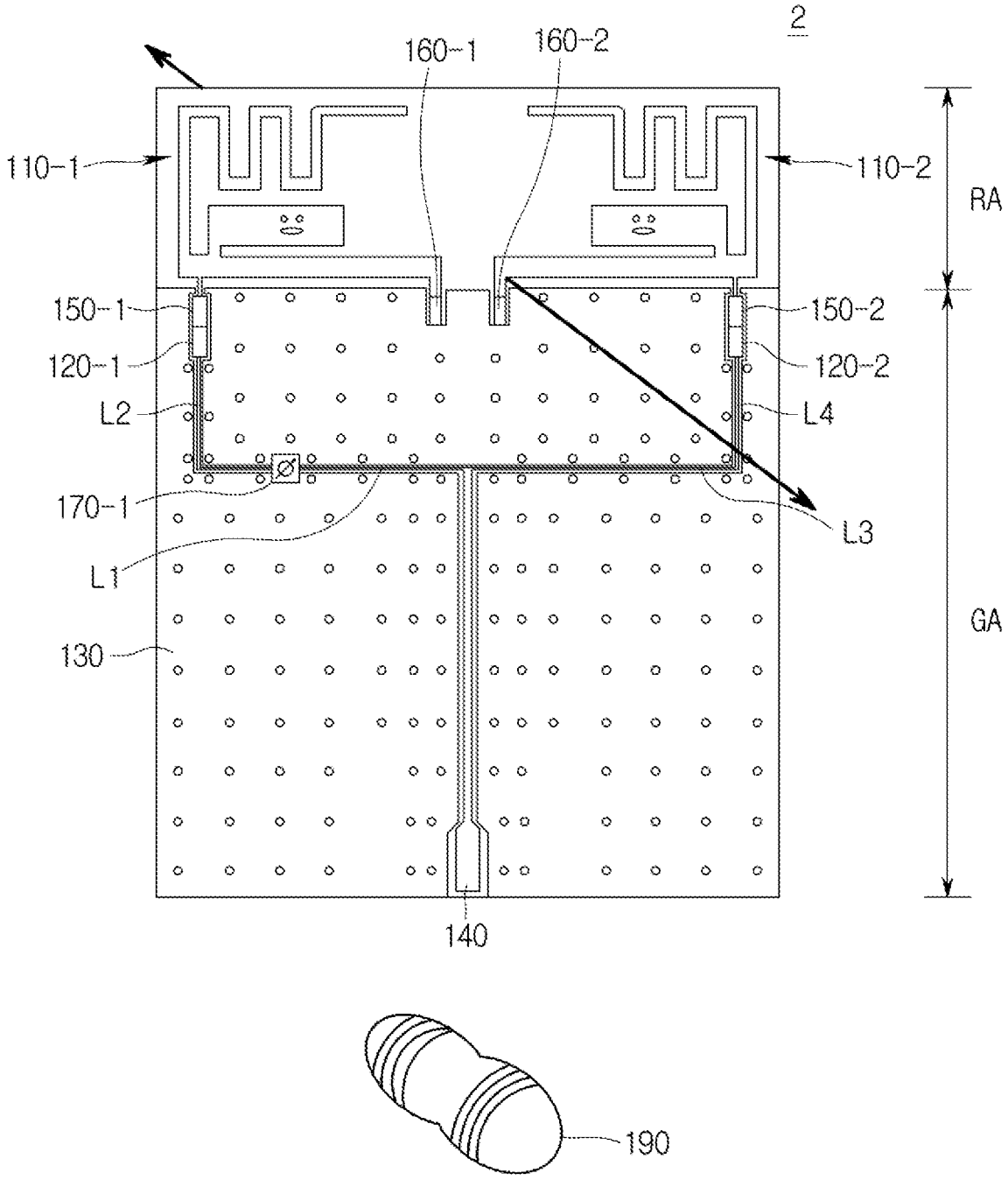
Figure 15:
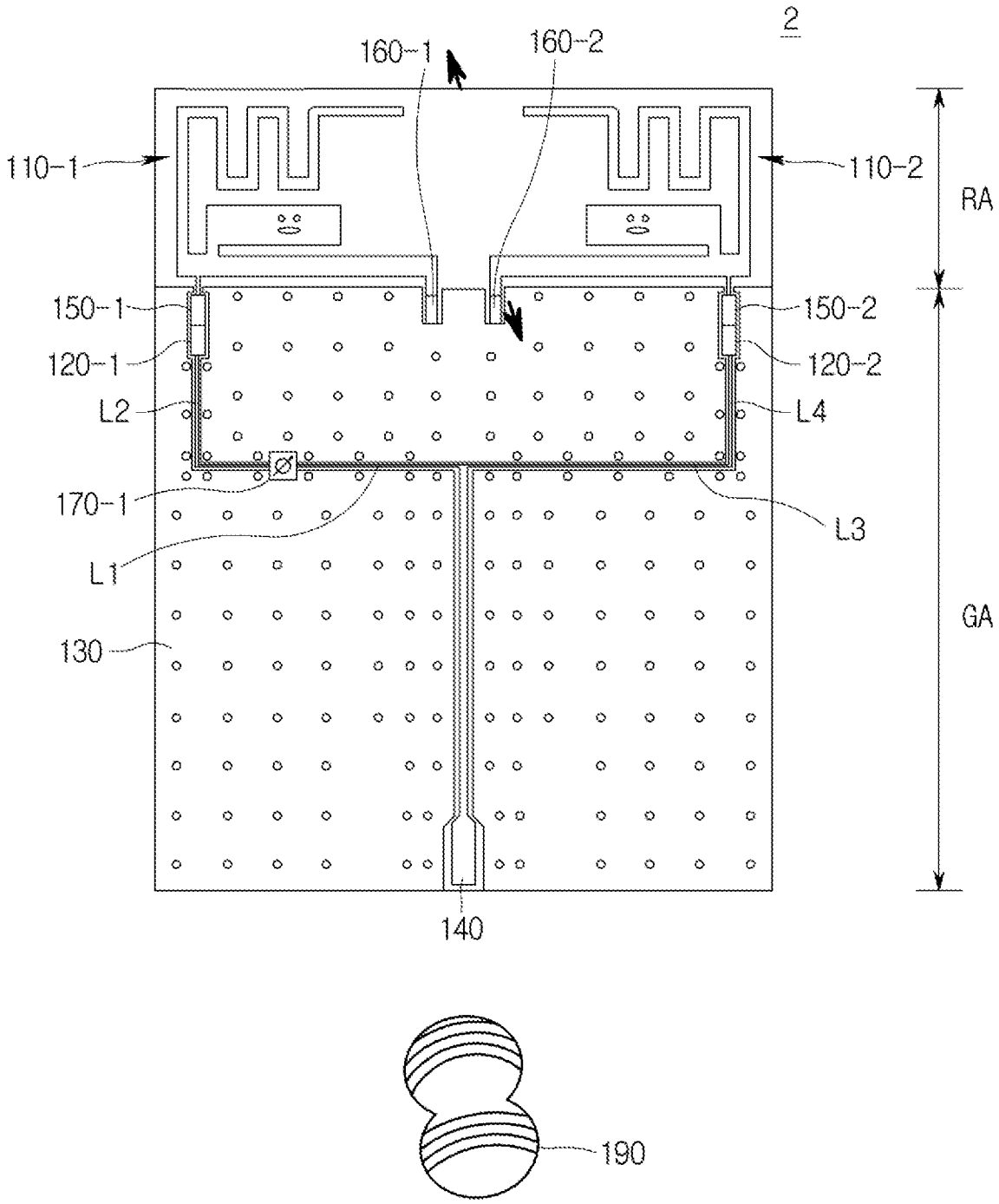

FIG. 11 is a circuitry diagram of a phase shifter according to one embodiment illustrated in FIGS. 9 and 10. Hereinafter, the construction of the phase shifter 170-1 for controlling the phase of an electrical signal to be applied to the first radiation circuit 110-1 will be described in detail. However, the construction of the phase shifter 170-1 illustrated in FIG. 11 is the same as the construction of the phase shifter 170-2 for controlling the phase of an electrical signal to be applied to the second radiation circuit 110-2.

The phase shifter 170-1 (and the phase shifter 170-2) includes first and second switches SW1 and SW2 and multiple stages Stage1, Stage2, Stage3, and Stage4 each of which is disposed between the first switch SW1 and the second switch SW2. The first and second switches SW1 and SW2 are selectively electrically connected to one of the multiple stages Stage1, Stage2, Stage3, and Stage4. That is, the first switch SW1 selectively connects the input circuit 140 with any one of the stages Stage1, Stage2, Stage3, and Stage4, and the second switch SW2 selectively connects the feeder circuit 120-1 with any one of the stages Stage 1, Stage2, Stage3, and Stage4.

At least one of the stages Stage 1, Stage2, Stage3, and Stage4 includes one or more passive elements such as resistors, inductors, and capacitors. The stages Stage1, Stage2, Stage3, and Stage4 have different impedance values that are determined depending on the type and number of the passive elements included in each of the stages. Electrical signals applied to the respective stages Stage1, Stage2, Stage3, and Stage4 are differently phase-shifted according to the impedance values of the respective stages Stage1, Stage2, Stage3, and Stage4, and the phase-shifted electrical signals are output to an external circuit through the second switch SW2. In the example of FIG. 11, a passive element set used to form a stage of the phase shifter is composed of an inductor and a capacitor but the configuration of the passive element set is not limited thereto.

When the first switch SW1 and the second switch SW2 are electrically connected to any one of the stages Stage1, Stage2, Stage3, and Stage4, the phase of an electrical signal is shifted according to the impedance value of the stage connected to the first and second switches SW1 and SW2. Although FIG. 11 illustrates an example in which the phase shifter 170-1 is configured with four stages Stage1, Stage2, Stage3, and Stage4 and the phase of an electrical signal is shifted according to one of fourth impedance values, the phase shifter 170-1 can be configured with more than four stages or less than four stages.

FIGS. 12 to 15 illustrate radiation patterns at different stages of the phase shifter. Specifically, FIGS. 12 to 15 illustrate radiation patterns of the dual antenna 2 for the respective cases where an electrical signal applied to the first radiation circuit 110-1 is phase-shifted by the first stage Stage1 of the phase shifter 170-1, an electrical signal applied to the first radiation circuit 110-1 is phase-shifted by the second stage Stage2 of the phase shifter 170-1, an electrical signal applied to the first radiation circuit 110-1 is phase-shifted by the third stage Stage3 of the phase shifter 170-1, and an electrical signal applied to the first radiation circuit 110-1 is phase-shifted by the fourth stage Stage4 of the phase shifter 170-1.

As illustrated in FIGS. 12 to 15, the dual antenna 2 including the multiple radiation circuits 110-1 and 110-2 can generate various radiation patterns in each of which a radiation signal is transmitted toward a specific direction (i.e., the direction of interest) by performing the phase control of an electrical signal. That is, when a communication counterpart device 190 is located at a specific position, the dual antenna 2 creates a radiation pattern in which a radiation signal is directed at the specific position (i.e., the communication counterpart device 190). That is, the dual antenna 2 supports beamforming according to the position of the communication counterpart 190.

Those skilled in the art will appreciate that various modifications and changes to the embodiments described herein and other various embodiments are possible, without departing from the scope and spirit of the embodiments. Therefore, the embodiments described above are to be considered, in all respects, as being illustrative and not restrictive. Therefore, it should be understood that the protection scope of the embodiments is defined by the appended claims rather than the description which is presented above. Moreover, the embodiments are intended to cover not only the exemplary embodiments but also various alternatives, modifications, and equivalents to the exemplary embodiments and other embodiments that can fall within the spirit and scope of the embodiments as defined by the appended claims.

What is claimed is:

1. A dual antenna comprising:

a radiation circuit including:

a first pattern having an L-shape;

a second pattern having a meandering shape;

a feed line electrically connected to the first pattern and the second pattern; and a ground line spaced apart from the feed line and electrically connected to the first pattern and the second pattern, wherein the first pattern comprises a first line extending in a first direction and having a first end electrically connected to the feed line and a second end, and a second line extending from the second end of the first line in a second direction perpendicular to the first direction, wherein the second line of the first pattern comprises at least one opening, and wherein the at least one opening is positioned further from the first line of the first pattern in the second direction than a middle of the second line of the first pattern.

2. The dual antenna of claim 1, wherein the second pattern comprises:

a first line extending to be parallel to the first line of the first pattern and having a first end electrically connected to the feed line and a second end; and a second line extending from the second end of the first line of the second pattern in the second direction and having a meandering shape.

3. The dual antenna of claim 2, wherein the second line of the first pattern has a width that is larger than a width of the first line of the first pattern.

4. The dual antenna of claim 2, further comprising a third pattern including a first end connected to the feed line and a second end connected to the ground line, the third pattern having an extended bar shape.

5. The dual antenna of claim 4, wherein the first line of the second pattern is connected to the first end of the third pattern, and the first line of the first pattern is connected to the third pattern and is spaced apart from the first line of the second pattern, and wherein the second line of the first pattern is closer to the third pattern than the second line of the second pattern.

6. The dual antenna of claim 2, further comprising:

an input circuit configured to receive a data signal from an external circuit;

a feeder circuit electrically connected to the input circuit and configured to:

convert the data signal into an electric signal, and output the electrical signal to the feed line; and a ground pad configured to ground the electrical signal supplied to the ground line.

7. The dual antenna of claim 6, wherein the input circuit and the feeder circuit are connected to each other via a first connecting line extending in the first direction from the feeder circuit and a second connecting line extending in the second direction from the first connecting line, and wherein a resistance of the first connecting line is different than a resistance of the second connecting line.

8. The dual antenna of claim 7, wherein the ground pad surrounds the input circuit and the feeder circuit, and portions of the first connecting line and the second connecting line between the input circuit and the feeder circuit.

9. The dual antenna of claim 1, wherein the at least one opening comprises:

a first opening extending in the first direction;

a second opening extending in the first direction; and a third opening larger than each of the first opening and the second opening, the third opening being spaced from each of the first opening and the second opening in the second direction.

10. The dual antenna of claim 1, wherein the first pattern is configured to output a radiation signal of a first frequency band, and the second pattern is configured to output a radiation signal of a second frequency band, the second frequency band being lower than the first frequency band.

11. A dual antenna comprising:

a first radiation circuit; and a second radiation circuit, wherein each of the first radiation circuit and the second radiation circuit comprises:

a first pattern having an L shape;

a second pattern having a meandering shape;

a first feed line electrically connected to the first pattern;

a second feed line electrically connected to the second pattern; and ground lines spaced apart from the first feed line and the second feed line and electrically connected to the first pattern and the second pattern, wherein the first pattern comprises a first line extending in a first direction and having a first end electrically connected to the first feed line and a second end, and a second line extending from the second end of the first line in a second direction perpendicular to the first direction, wherein the second line of the first pattern comprises at least one opening, and wherein the at least one opening is positioned further from the first line of the first pattern in the second direction than the middle of the second line of the first pattern.

12. The dual antenna of claim 11, wherein the first radiation circuit and the second radiation circuit are symmetrically arranged with respect to a first axis parallel to a first direction.

13. The dual antenna of claim 12, further comprising:

an input circuit configured to receive a data signal from an external circuit;

a first feeder circuit and a second feeder circuit, each of the first feeder circuit and the second feeder circuit being connected to the input circuit via a connecting line and configured to:

convert the data signal into an electric signal, and output the electrical signal to a corresponding one of the first feed line and the second feed line;

a ground pad for grounding the electrical signals supplied to the respective ground lines; and a first phase shifter connected between the first feeder circuit and the input circuit.

14. The dual antenna of claim 13, wherein the first phase shifter comprises:

multiple stages having different impedance values, a first switch for selectively connecting any one of the multiple stages to the input circuit; and a second switch for selectively connecting any one of the multiple stages to the first feeder circuit.

15. The dual antenna of claim 13, further comprising a second phase shifter connected between the second feeder circuit and the input circuit.

16. The dual antenna of claim 11, wherein the second pattern comprises:

a first line extending parallel to the first line of the first pattern, the first line having a first end electrically connected to the second feed line and a second end; and a second line extending from the second end of the first line of the second pattern in the second direction and having a meandering shape.

17. A dual antenna comprising:

a first layer, a second layer, a third layer, and a fourth layer that are stacked on each other in a first direction, wherein the first layer comprises:

an input circuit configured to receive a data signal from an external circuit;

a feeder circuit electrically connected to the input circuit and configured to convert the data signal into an electrical signal and to output the electrical signal;

a radiation circuit configured to generate a radiation signal according to the electrical signal output from the feeder circuit; and a first ground pad for grounding the electric signal supplied to the radiation circuit, wherein the second layer comprises a second ground pad arranged to correspond to the first ground pad and provided with openings at positions corresponding to the input circuit and the feeder circuit, wherein the third layer comprises a third ground pad, and wherein the fourth layer comprises a fourth ground pad.

18. The dual antenna of claim 17, wherein the first ground pad, the second ground pad, the third ground pad, and the fourth ground pad are electrically connected to each other through a via-hole.

* * * * *